US007456233B2

(12) United States Patent
Saidman

(10) Patent No.: US 7,456,233 B2
(45) Date of Patent: Nov. 25, 2008

(54) ADHESIVE COMPOSITION

(75) Inventor: Laurence B. Saidman, Duluth, GA (US)

(73) Assignee: Nordson Corporation, Westlake, OH (US)

( * ) Notice: Subject to any disclaimer, the term of this patent is extended or adjusted under 35 U.S.C. 154(b) by 397 days.

(21) Appl. No.: 11/059,098

(22) Filed: Feb. 16, 2005

(65) Prior Publication Data

US 2006/0183823 A1 Aug. 17, 2006

(51) Int. Cl.

| | |
|---|---|
| ***C08F 263/04*** | (2006.01) |
| ***C08F 265/02*** | (2006.01) |
| ***C08F 255/02*** | (2006.01) |
| ***C08K 5/01*** | (2006.01) |
| ***C08L 93/04*** | (2006.01) |
| ***C09D 151/00*** | (2006.01) |

(52) U.S. Cl. ..... 523/201; 523/205; 523/206; 523/207; 523/208; 523/210; 524/114; 524/196; 524/231; 524/271; 524/322; 524/445; 524/474; 524/487

(58) Field of Classification Search ..... 523/201, 523/205, 206, 207, 208, 210; 524/114, 196, 524/231, 265, 271, 322, 445, 474, 487
See application file for complete search history.

(56) References Cited

U.S. PATENT DOCUMENTS

| | | | |
|---|---|---|---|
| 3,170,888 | A | 2/1965 | Kutik et al. |
| 3,237,776 | A | 3/1966 | Painter et al. |
| 3,318,825 | A | 5/1967 | Enk et al. |
| 3,620,878 | A | 11/1971 | Guthrie |
| 3,632,021 | A | 1/1972 | MacManus |
| 3,635,849 | A | 1/1972 | Hanson |
| 3,644,257 | A | 2/1972 | Nickerson et al. |
| 3,676,526 | A | 7/1972 | Sommerfeld |
| 3,717,875 | A | 2/1973 | Arciprete et al. |
| 3,835,116 | A | 9/1974 | Lydick |
| 3,868,433 | A | 2/1975 | Bartz et al. |
| 3,884,995 | A | 5/1975 | Seiler |
| 3,886,234 | A | 5/1975 | Ishihara et al. |
| 3,891,584 | A | 6/1975 | Ray-Chaudhuri et al. |
| 3,926,899 | A | 12/1975 | Nordberg |
| 4,136,069 | A | 1/1979 | Vachon et al. |
| 4,338,227 | A | 7/1982 | Ballard |
| 4,359,551 | A | 11/1982 | Suda et al. |
| 4,387,174 | A | 6/1983 | Lundberg et al. |
| 4,391,853 | A | 7/1983 | Pointon |
| 4,401,782 | A | 8/1983 | Conklin et al. |
| 4,420,575 | A | 12/1983 | Rapaport et al. |
| 4,458,057 | A | 7/1984 | Basu |
| 4,460,728 | A | 7/1984 | Schmidt, Jr. et al. |
| 4,540,037 | A | 9/1985 | Langner |
| 4,581,413 | A | 4/1986 | Kim |
| 4,602,056 | A | 7/1986 | Waniczek et al. |
| 4,602,058 | A | 7/1986 | Graham et al. |
| 4,668,731 | A | 5/1987 | Lochhead et al. |
| 4,714,730 | A | 12/1987 | Briggs et al. |
| 4,767,669 | A | 8/1988 | Conklin et al. |
| 4,774,144 | A | 9/1988 | Jachec et al. |
| 4,774,277 | A | 9/1988 | Janac et al. |
| 4,833,193 | A | 5/1989 | Sieverding |
| 4,844,959 | A | 7/1989 | Read et al. |
| 4,875,964 | A | 10/1989 | Marius |
| 4,900,771 | A | 2/1990 | Gerace et al. |
| 4,906,497 | A | 3/1990 | Hellmann et al. |
| 4,937,138 | A | 6/1990 | Mostert |
| 4,948,822 | A | 8/1990 | Iovine et al. |
| 4,959,405 | A | 9/1990 | Briggs et al. |
| 5,089,364 | A | 2/1992 | Lee et al. |
| 5,143,961 | A | 9/1992 | Scholl et al. |
| 5,177,122 | A | 1/1993 | Shih |
| 5,271,881 | A | 12/1993 | Redding, Jr. |
| 5,278,224 | A | 1/1994 | Olesen et al. |
| 5,298,552 | A | 3/1994 | Borghi et al. |
| 5,319,007 | A | 6/1994 | Bright |
| 5,391,601 | A | 2/1995 | Teeters et al. |
| 5,414,039 | A | 5/1995 | Watson et al. |
| 5,539,043 | A | 7/1996 | Kimura et al. |
| 5,543,488 | A | 8/1996 | Miller et al. |
| 5,552,495 | A | 9/1996 | Miller et al. |
| 5,552,511 | A | 9/1996 | Miller et al. |
| 5,571,876 | A | 11/1996 | Miller et al. |
| 5,605,764 | A | 2/1997 | Miller et al. |
| 5,631,313 | A | 5/1997 | Bishop et al. |
| 5,718,790 | A | 2/1998 | Miller et al. |
| 5,763,516 | A | 6/1998 | Godfrey |
| 5,837,089 | A | 11/1998 | Magrum |
| 5,852,080 | A | 12/1998 | Philbin et al. |
| 5,859,152 | A | 1/1999 | Miller et al. |
| 5,869,567 | A | 2/1999 | Fujita et al. |
| 5,883,166 | A | 3/1999 | Jennings et al. |
| 5,932,638 | A | 8/1999 | Righettini et al. |
| 5,972,272 | A | 10/1999 | Nagase et al. |

(Continued)

FOREIGN PATENT DOCUMENTS

| | | |
|---|---|---|
| WO | WO 01/53389 A1 | 7/2001 |

*Primary Examiner*—Ana L Woodward
(74) *Attorney, Agent, or Firm*—Wood, Herron & Evans, L.L.P.

(57) ABSTRACT

An adhesive formulation comprising at least a reinforcing phase, a liquid phase and an adsorbent phase. The adsorbent phase, in particle form, has a surface coating which renders the adsorbent phase non-interactive and non-reactive with at least the reinforcing phase and liquid phase.

6 Claims, No Drawings

U.S. PATENT DOCUMENTS

| | | | | |
|---|---|---|---|---|
| 6,001,912 | A | 12/1999 | Schneider | |
| 6,017,586 | A | 1/2000 | Payn et al. | |
| 6,111,013 | A | 8/2000 | Simpson et al. | |
| 6,203,911 | B1 | 3/2001 | Weberg et al. | |
| 6,207,077 | B1 | 3/2001 | Burnell-Jones | |
| 6,255,367 | B1 | 7/2001 | Bitler et al. | |
| 6,281,272 | B1 | 8/2001 | Baldy et al. | |
| 6,316,088 | B1 | 11/2001 | Ogawa et al. | |
| 6,365,277 | B1 | 4/2002 | Wilson | |
| 6,365,656 | B1 | 4/2002 | Green et al. | |
| 6,440,534 | B1 | 8/2002 | Wilson | |
| 6,454,974 | B1 | 9/2002 | Wilson | |
| 6,486,246 | B1 | 11/2002 | Vion | |
| 6,548,579 | B2 | 4/2003 | Reski et al. | |
| 6,703,127 | B2 | 3/2004 | Davis et al. | |
| 7,285,583 | B2 * | 10/2007 | Stumphauzer et al. | 523/201 |
| 2001/0021733 | A1 | 9/2001 | Peltonen et al. | |
| 2002/0013399 | A1 | 1/2002 | Grooves | |
| 2002/0045605 | A1 | 4/2002 | Thompson | |
| 2002/0068782 | A1 | 6/2002 | Snedoon | |
| 2002/0198296 | A1 | 12/2002 | Rawlinson et al. | |
| 2004/0029980 | A1 * | 2/2004 | Stumphauzer et al. | 516/31 |

* cited by examiner

ADHESIVE COMPOSITION

FIELD OF THE INVENTION

This invention relates generally to adhesive compositions and, more particularly, to adhesives for use in package and carton sealing applications.

BACKGROUND OF THE INVENTION

Hot melt adhesives are routinely used in various applications where a stable surface-to-surface bond must be formed. Further, hot melt adhesives are used in securing a variety of both similar and dissimilar materials together in a mating relationship, such as wood, plastics, corrugated films, paper, carton stock, metals, rigid PVCs, fabrics, leathers, and others. These adhesives are especially useful in applications where it is desirable to have the adhesive solidify rapidly after being dispensed.

One particularly significant area for use of hot melt adhesives is in package and carton sealing. Utilizing equipment generally known in the art, the hot melt adhesive is brought from a storage condition to an application condition and then applied to one or both surfaces of the materials which are to be mated in the package forming or carton sealing application.

One type of adhesive which has been traditionally used in package and carton sealing applications is based on ethylene vinyl acetate (EVA) and may be applied to the substrate, for example, by spray technique or by use of a hot gun.

Another material useful in package and carton sealing applications is a composition based on methyl methacrylate resins. Yet another alternative is a composition based on polyurethane resin (PUR).

In yet another variation, a multi-component adhesive composition intended for use in hot melt applications is comprised of several polymeric materials initially dispersed in a liquid or a low melting solid carrier.

This type of composition, generally of the type disclosed in patent application Publication No. U.S. 2004/0029980, by William C. Stumphauzer and Anthony A. Parker, is described as an adhesive composition containing multiple components. The composition is comprised broadly of a liquid phase, a reinforcing phase, an adsorbent phase, an activator, a thermal stabilizer, and optional secondary additives.

One of the challenges in preparing a multi-component adhesive composition containing the above functional components is substantially reducing or eliminating the tendency of the composition to "pack out". This condition is observed, if at all, typically during the dispensing and application of the adhesive composition. Instead of readily flowing as a solid component dispersed within the liquid carrier, one (or more) of the solid components of the composition softens and tends to separate from the remaining components. As this component separates, it tends to block movement of the remaining dispersion components through the pumping apparatus, the dispensing head, or both. This tendency to interrupt movement of the remaining dispersion components can either hamper, or completely block, the flow. Further, the component which forms the bulk of the packed out material becomes physically separated from the remaining dispersion components, thereby altering the actual composition of the material being dispensed onto the substrate.

In the above multi-component adhesive composition, the adsorbent phase tends to interact with the liquid carrier phase as the storage condition temperature increases. As a result, the adsorbent phase tends to swell and become more sticky, thereby separating more readily from the other components of the adhesive composition, i.e., pack out.

SUMMARY OF THE INVENTION

To reduce the tendency of such multi-component adhesive compositions to pack out prior to application, the invention modifies the adsorbent phase of the multi-component adhesive composition. Generally, in the multi-component compositions described below, the liquid phase provides the medium which carries the remaining dispersed particles from a storage location to the final dispensing point. The reinforcing phase generally is the primary contributor to the cohesive strength of the adhesive composition. The adsorbent phase generally functions to entrain or trap the liquid phase upon heating and dispensing of the composition onto a substrate such that the liquid phase remains enabled to facilitate the dispersion and thereby flowability of the adhesive composition prior to adhesive processing. During and after adhesive processing the adsorbent phase prevents the liquid phase from separating or otherwise exuding from the dispensed adhesive onto the substrate.

To better enable the adhesive to perform an adhesive function, one or more activators may be incorporated into the composition. Further, one or more thermal stabilizers may also be added to limit or prevent chemical changes to the composition during the heating step prior to and during dispensing of the composition. Optionally, other characteristics of the adhesive composition may be adjusted or controlled by one or more secondary additives. These additives may be incorporated for the purpose of adjusting the working time of the composition, the composition viscosity, and the like.

Prior to heating of the adhesive composition in preparation for dispensing onto a substrate, the adhesive composition in the form of a dispersion will typically be stored for some period of time. During that storage period, it is highly preferred that none of the individual components of the adhesive composition interact with each other to any substantial degree. Thus, under storage conditions the reinforcing phase preferentially is non-reactive and non-interactive with each of the other components; likewise, the liquid carrier phase, adsorbent phase, activator and thermal inhibitor preferentially are non-reactive and non-interactive with each of the other components. Nonetheless, storage temperatures typically range from as low as the ambient outdoor temperature up to about 150° F., which in turn reflects the ambient temperature modified by heat trapped within the storage building, tank, container, or the like. As the storage temperature increases, an unprotected adsorbent phase can interact with at least the liquid carrier phase, and exhibit the packing out phenomenon.

The tendency of the adsorbent phase under high temperature storage conditions to pack out can be minimized or eliminated by better isolating the adsorbent phase from the liquid phase. Thus, the adsorbent phase receives a coating or surface sealing layer, such as would be accomplished by appropriately treating this phase, for example, in a core shell emulsion process prior to incorporation into the composition. Thus, a coating is provided, by chemical processing, solvent deposition, molten phase coating, or the like, over the adsorbent phase material such that the adsorbent comprises the core of the resultant particle, and the coating comprises the shell. Providing a substantially non-reactive or non-interactive surface over the adsorbent phase material, typically in the form of discrete particles, substantially eliminates the possible interaction between the adsorbent phase and the liquid carrier phase. As a result, the adsorbent phase does not swell and thereby does not become susceptible to packing out during storage and subsequent processing of the adhesive composition.

DETAILED DESCRIPTION OF THE INVENTION

In its broader aspects, the invention is directed to an adhesive composition comprised of particles dispersed within a liquid component, wherein the composition includes a polymeric reinforcing phase component, an adsorbent phase component comprised of a core adsorbent composition and a dissimilar coating composition, the coating composition providing a substantially contiguous surface which inhibits contact between the liquid component and the adsorbent phase core composition below a temperature of about 250° F. (121° C.), wherein the reinforcing phase component is substantially incompatible with the liquid component, and the reinforcing component is dissimilar from the adsorbent phase component. Adhesive compositions are generally disclosed in the Stumphauzer United States patent application Publication No. US 2004/0029980, incorporated herein by reference. One manner of producing the coated adsorbent phase component is to utilize emulsion polymerization as a polymer processing technique to produce a plurality of adsorbent particles containing the adsorbent phase component as the core with a dissimilar shell coating. Another manner of producing a coated adsorbent phase component is to dissolve the coating material in a solvent which in turn is non-reactive and non-interactive with the adsorbent phase material, allowing the coating material dissolved in solvent to come into contact with the surface of the adsorbent phase material, and then removing the solvent.

The liquid phase component is characterized by a lack of reaction and of interaction with at least the reinforcing and adsorbent phases of the composition. Representative liquid phase component materials include both naturally derived and synthetically derived products. These products are generally liquid at room temperature, but may also include low melting solids. Naturally derived materials include but are not limited to mineral oil; lipophilic materials having carboxylic acid functionality such as isostearic acid; esters of dicarboxylic acids such as adipic, sebacic, and phthalic acids; monocarboxylic acid esters derived from methanol, glycerin and the like; vegetable oils such as those derived from soy and epoxidized soy; and naturally derived aliphatic hydrocarbons. Synthetically derived materials include but are not limited to low molecular weight acrylic polymers; low molecular weight epoxy polymers; low molecular weight isocyanate based materials; trialkoxysilane, wherein the organic chain is comprised of a relatively low number of carbons; and hydrolyzed and oligomerized derivatives thereof. In addition, the liquid phase materials may include synthetically derived aliphatic hydrocarbons. In certain circumstances, higher polarity, i.e., hydrophilic, materials may be used, including but not limited to water, glycerin, ethylene glycol and propylene glycol. Generally, depending on the final formulation composition desired, the liquid phase component may comprise any low volatility liquid compound which is compatible in the finished adhesive with the adsorbent phase.

The reinforcing phase component is also characterized by a lack of reaction and interaction with at least the adsorbent and liquid phases. The reinforcing phase functions to provide the cohesive strength which ultimately adheres the two or more similar or dissimilar substrates together. The reinforcing phase is present in greater quantity based on relative percentage by weight than the adsorbent phase in part because of the need to maintain the cohesive strength relative to the risk of having excess liquid phase interfere with the adherence between the substrates. Representative reinforcing phase materials are generally polymeric, synthetically derived compounds, including but not limited to polyolefins; poly(ethylene-co-vinyl acetate); ethylene vinyl acetate; copolymers made from monomers of ethylene, propylene, butylene, butadiene or higher repeating carbon units, polymerized with one or more of vinyl acetate, methyl acrylate, methyl methacrylate, butyl acrylate, styrene, maleic anhydride, maleic acid, acrylic acid, methacrylic acid, vinyl methyl ether, glycidyl ethers, trimethylolpropanemonoallylether, and vinyl chloride; polyvinyl alcohol; copolymers of polyvinyl alcohol, such as polyvinylbutyral, polyvinylformal, and ethylene vinyl alcohol; polyamides; and polyvinylpyrrolidone copolymers. Also, polymers having acid, alcohol, or anhydride functions which chemically react are useful. Further, core-shell emulsion technology may be utilized to generate a core portion of the desired reinforcing phase material which has acceptable cohesive strength properties and a shell that provides shelf stability upon dispersing of the particles in the liquid phase. For example, a useful core-shell polymeric combination may include a core comprising a terpolymer of polyethylene-co-vinylacetate-co-methacrylic acid with a vinyl acetate content of greater than 15%, and a shell comprising a copolymer of ethylene and vinyl acetate wherein the vinyl acetate content is less than 9%. The acceptable reinforcing phase material provides the finished adhesive composition with its mechanical integrity. This phase is able to fuse, melt and quickly cool to become a solid after application to the substrate. The reinforcing phase, as dispersed particles, will combine with the liquid phase with heating to form a molten blend. The rheological characteristics of the reinforcing phase affect the temperature of fusion, the characteristics being controlled by polymer molecular weight, copolymer composition solubility with the liquid phase and other components of the composition, and the compositional ratios of the components.

The adsorbent phase component is also characterized by lack of reaction and interaction with at least the other two main phases, i.e., the reinforcing and liquid phases. The adsorbent phase material is typically a solid at room temperature, and under storage conditions exists as a solid particle dispersed in the liquid phase. The adsorbent phase component is either a naturally derived material or a synthetically derived material. Representative naturally derived materials include but are not limited to stearic acid, azelaic acid, benzoic acid, citric acid, tartaric acid, biotin, and niacin. Also included are higher molecular weight aliphatic hydrocarbon waxes, esters, terpene resins, and rosin esters, an example of the latter being a pentaerythritol ester of tall oil rosin. Synthetically derived materials include copolymers of polypropylene and maleic anhydride. Also included are non-polar polyolefins such as polypropylene, polypropylene copolymers, polyethylene, polyethylene copolymers, and polystyrene copolymers. Also included are polyolefins having relatively higher levels of polarity, such as nylon, polycaprolactone, and polyvinyl alcohol and its copolymers. Further, the adsorbent phase material may also include inorganic fillers, and high surface area inorganic materials, especially nano materials, with and without surface treatment. Further, combinations of the above materials may be blended to customize the properties of the adsorbent phase. Generally, the adsorbent phase is incorporated into the adhesive formulation such that the adsorbent phase is present in a lesser quantity based on relative percentage by weight than the reinforcing phase.

The adsorbent component described above is advantageously protected from interaction with at least the liquid phase component and reinforcing component within the adhesive composition by a coating layer which at least substantially surrounds the core adsorbent component. In one embodiment, individual particles of the adsorbent component are surrounded by a shell which isolates the core adsorbent component particles until the adhesive composition is subjected to elevated temperature and shear, typically though not necessarily encountered at the applicator device. The adsorbent component coating comprises a sufficiently small quantity in the adhesive composition and has sufficiently non-interactive characteristics so as to not interfere to any substantial degree with the adsorbent function or reinforcing function of those respective components in connection with applying the adhesive composition onto the substrate. Preferably, the coating is not breached by only the action of a shear force, because the coated adsorbent component could begin to interact with the other components of the adhesive composition as a result of shear forces generated at the pump, which potentially is remote from the point of application of the adhesive composition. In one embodiment, the adsorbent component coating is selected so that its structural integrity begins to weaken within a temperature range between the anticipated maximum storage temperature and the application temperature.

The adsorbent component coating or shell material is at least substantially non-reactive and non-interactive with the liquid phase of the adhesive composition. As the liquid component is typically a lipophilic material, the coating preferably is comprised of a material which is more lipophobic, or less likely to dissolve in oil. In those instances where the liquid phase has a more hydrophilic characteristic, the coating surrounding the individual adsorbent component particles is preferably comprised of a material which is hydrophobic, or less likely to dissolve in water. In both instances, the intention is for the coating material over the adsorbent component core to be at least substantially non-reactive and non-interactive with the liquid phase and reinforcing component phase and thereby not be affected by either of these components during manufacture, storage and manipulation of the adhesive composition prior to use.

Where the adhesive composition is formulated to utilize monomers having different hydrophilic characteristics, polymerization may be effected by dispersing an aqueous solution of monomer in a non-aqueous phase. This technique is generally referred to as an inverse or a water-in-oil emulsion. Inverse emulsion polymerization employs emulsions which are often less stable than the oil-in-water type. One advantage of the emulsion polymerization technique is that it provides an advantage of preparing polymers in a form suitable for direct use in adhesive and coating formulations.

The coating for the adsorbent phase particle may be applied through utilization of any of a number of techniques known to one of skill in the art, such as core-shell emulsion polymerization, coacervation, interfacial polymerization, in situ polymerization, and solvent evaporation. One or more of these techniques is described in more detail in U.S. Pat. Nos. 6,703,127, 4,948,822, 5,177,122, and 5,271,881, which are incorporated herein by reference.

One exemplary technique for polymer processing known in the art is emulsion polymerization. Emulsion polymerization utilizes water as the dispersing medium and is therefore able to transfer heat very efficiently. Monomer is dispersed in the aqueous phase by an emulsifying agent such as a detergent. Initiator radicals are generated in the aqueous phase. Usually, these initiator radicals are the redox type. These initiator radicals diffuse into soap micelles swollen with monomer molecules. As the monomer is consumed in the polymerization reaction, additional monomer dispersed in the aqueous phase then migrates into the micelle and thereby continues the reaction. Termination of the reaction occurs by combination when a new radical diffuses into the micelle. Typically, only one radical is present in the micelle prior to termination, and thus extremely high molecular weight polymers may be obtained. To control the degree of polymerization, mercaptans or other chain transfer agents are normally incorporated.

The material comprising the coating layer for the adsorbent particle is selected on the basis of lack of interaction and lack of reactivity toward the other component materials of the adhesive composition while maintained in a condition prior to application, ease of coating or deposition onto the discrete adsorbent particles, and lack of effect on the final properties of the adhesive composition applied to the substrate. For example, where the liquid component is a lipophilic material, the coating layer for the adsorbent phase should preferably be sufficiently lipophobic so as to not interact or react with the liquid component in any significant respect, thereby maintaining the integrity of the coating and contributing in no significant respect to any change in the rheological characteristics of the composition prior to application onto the substrate.

Representative materials which can be used as a coating or shell for the core particle, include, but are not limited to, urea formaldehyde resins, melamine formaldehyde resins, polyvinyl alcohol, and aqueous acrylic resins such as those derived from methacrylates, and polyacrylamide. Additional materials include carboxymethylcellulose, succinylated gelatin, starch, gum arabic, polyvinyl alcohol, polystyrene, polyester, polyamide, ethylene-vinyl acetate copolymer, polyurethane, polyvinylpyrrolidone and polyacrylamide.

During the process of applying the adhesive composition to a substrate, the material comprising the coating must permit at least a substantial portion of the adsorbent phase component to perform its adsorbent function. Thus, if the application temperature for the adhesive composition is elevated relative to the storage temperature, the material comprising the coating releases from or flows away from the adsorbent phase component, or is otherwise dissolved or altered by the combined effect of elevated temperature and liquid component (or other mechanism to thereby expose at least a substantial portion of the adsorbent phase component. The ultimate application temperature would therefore affect the choice of material comprising the coating. Alternatively, the material comprising the coating can fracture or otherwise separate from the adsorbent phase particle during the process of applying the adhesive to the substrate. Fracturing of the coating can be facilitated by heating of the adsorbent phase to a temperature above its melting point, thereby allowing the adsorbent phase particle to more readily deform.

The adhesive is formulated by simple mixing of the components at or near room temperature. In one embodiment, the adhesive composition can be applied to a substrate by conveying the stored, homogeneous adhesive to the application location by means of a piston pump, such as a 16:1 Model 25B Pump Unit, available from Nordson Corporation, Westlake, Ohio. The adhesive flows through an appropriately sized pressure line to a heater unit, such as the Nordson NH-4 Paint Heater with a modified thermostat for high temperature setting control, and heated to a temperature of about 350° F. Thereafter, the heated adhesive formulation flows under pressure through a hot melt hose to a hot melt gun, such as the Nordson H-201 Gun, for application onto the substrate. Hot melt hose and gun temperatures are controlled using a TC-200 Temperature Control unit from Nordson Corporation.

While the present invention has been illustrated by the description of the various embodiments thereof, and while the embodiments have been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicant's general inventive concept.

What is claimed is:

1. An adhesive composition comprised of polymeric reinforcing particles and adsorbant phase component particles dispersed within a liquid component, wherein said polymeric reinforcing particles comprise a polymeric reinforcing phase component; and wherein said adsorbent phase component particles comprise a core composition coated with a dissimilar coating composition, said coating composition providing a contiguous surface which inhibits contact between said liquid component and said core composition below a temperature of about 121° C.; wherein said reinforcing phase component upon heating provides cohesive strength to said adhesive composition and is substantially incompatible with said liquid component, and said reinforcing phase component is dissimilar from said core composition and wherein said core composition upon heating is effective to entrain said liquid component.

2. The adhesive composition of claim 1 wherein said coating composition is a shell applied to said core composition using emulsion polymerization processing.

3. The adhesive composition of claim 1 wherein the reinforcing phase component is selected from the group consisting of polyolefin; poly(ethylene-co-vinyl acetate); copolymers made from monomers of ethylene, propylene, butylene, butadiene or higher repeating carbon units, polymerized with one or more of vinyl acetate, methyl acrylate, methyl methacrylate, butyl acrylate, styrene, maleic anhydride, maleic acid, acrylic acid, methacrylic acid, vinyl methyl ether, glycidyl ethers, trimethylolpropanemonoallylether, and vinyl chloride; polyvinyl alcohol; polyvinylbutyral; polyvinylformal; polyamides; and polyvinylpyrrolidone copolymers; and combinations thereof.

4. The adhesive composition of claim 1 wherein the core component is solid at room temperature and is selected from the group consisting of stearic acid, azelaic acid, benzoic acid, citric acid, tartaric acid, biotin, niacin, aliphatic hydrocarbon waxes, aliphatic hydrocarbon esters, aliphatic hydrocarbon terpene resins, aliphatic hydrocarbon rosin esters, copolymers of polypropylene and maleic anhydride, polypropylene, polypropylene copolymers, polyethylene, polyethylene copolymers, polystyrene copolymers, nylon, polycaprolactone, polyvinyl alcohol, copolymers of polyvinyl alcohol, pentaerythritol esters of tall oil rosin; and combinations thereof.

5. The adhesive composition of claim 1 wherein the liquid phase component is selected from the group consisting of mineral oil, isostearic acid, adipic acid ester, sebacic acid ester, phthalic acid ester, methyl esters of monocarboxylic acid, glycerin esters of monocarboxylic acids, soy oil, epoxidized soy oil, naturally derived aliphatic hydrocarbons, low molecular weight acrylic polymers, low molecular weight epoxy polymers, low molecular weight acrylic polymers, low molecular weight isocyanates, trialkoxysilane, synthetically derived aliphatic hydrocarbons; and combinations thereof.

6. The adhesive composition of claim 1 wherein the coating composition is selected from the group consisting of urea formaldehyde resins, melamine formaldehyde resins, polyvinyl alcohol, methacrylates, polyacrylamide, carboxymethylcellulose, succinylated gelatin, starch, gum Arabic, polyvinyl alcohol, polystyrene, polyester, polyamide, ethylene-vinyl acetate copolymer, polyurethane, polyvinylpyrrolidone, polyacrylamide; and combinations thereof.

* * * * *